US006485539B1

(12) United States Patent
Sokolov

(10) Patent No.: US 6,485,539 B1
(45) Date of Patent: Nov. 26, 2002

(54) METHOD OF ALNIKO ALLOY MELTING

(76) Inventor: Vladislav M. Sokolov, Pr. Vernadskogo, 73a, f.21, Kylv 252142 (UA)

( * ) Notice: Subject to any disclaimer, the term of this patent is extended or adjusted under 35 U.S.C. 154(b) by 0 days.

(21) Appl. No.: 09/674,113

(22) PCT Filed: Oct. 30, 1998

(86) PCT No.: PCT/UA98/00018

§ 371 (c)(1),
(2), (4) Date: Oct. 21, 2000

(87) PCT Pub. No.: WO99/55923

PCT Pub. Date: Nov. 4, 1999

(30) Foreign Application Priority Data

Apr. 27, 1998 (UA) ..... 98042085

(51) Int. Cl.[7] ..... C22B 9/16; C22C 21/00
(52) U.S. Cl. ..... 75/10.14; 75/10.46; 420/590
(58) Field of Search ..... 75/10.14, 10.1, 75/10.46; 420/590

(56) References Cited

U.S. PATENT DOCUMENTS 5,520,748 A * 5/1996 Yang et al. ..... 148/104

FOREIGN PATENT DOCUMENTS

| | | |
|---|---|---|
| JP | 59190338 | 10/1984 |
| JP | 06179901 | 6/1994 |
| JP | 10022111 | 1/1998 |

OTHER PUBLICATIONS

DV.M. Pyatin "Postoyannye Magnity" Spravochnik Moscow "Energya" 1980, p.p. 310–311 No Month.

* cited by examiner

*Primary Examiner*—Roy King
*Assistant Examiner*—Tima McGuthry-Banks
(74) *Attorney, Agent, or Firm*—I. Zborovsky

(57) ABSTRACT

A method of alnico alloy melting includes melting a charge, oxidizing refining of the melted charge, with the melting including introducing the charge into a flux that is heated try electrical current, maintaining a temperature of the flux in a range of 1500–1800° C., and carrying out the oxidizing refining until an aluminum content reaches 0.05–1.0%.

5 Claims, No Drawings

METHOD OF ALNIKO ALLOY MELTING

This invention relates to metallurgy sphere, particularly to the methods of alloy melting, making use of high-alloyed waste as pieces and fine-dispersed particles containing large amount of non-metal component.

There is a well-known and widely used method by which the waste of ALNIKO alloy, including powder-like one of grinding process, that contains large quantity of a non-metal component is melted and oxidizing refined in an open furnace and then the melt is poured. After this the alloy obtained is melted in another installation followed by additional alloying up to definite composition. (Aba K. Kinzoku: 1977, v.47, No. 10, p.26–30). The main disadvantage of above method is the considerable loss of waste fine-dispersed component because. some amount of it turns as suspended matter to ambient of furnace open space in melting. This powder is irretrievably taken away by effluent gases. Another disadvantage of that method is the restriction related to the possibility of using the powder-like waste in charge (no more than 50%). These restrictions are caused by the difficulty of powder-like waste melting with electric arc.

An object of this invention is to increase the waste metal component and the percentage of possible using of the powder-like charge component through the maintaining the melting conditions at which the waste is remelted in liquid flux the base of present invention makes. With this the harmful non-metal component is bound with flux and the powder-like waste could be remelted practically unlimitedly.

To this aim the method of ALNIKO alloy melting, is proposed, including the charge melting followed by its oxidizing refining. In accordance with the invention the proposed method supposes the charge melting in the layer of flux heated by electric current passed through it. The metal component of powder-like waste is absorbed by flux and the suspended matter irretrievably taken away from the furnace atmosphere by effluent gases does not form. As a result the waste utilization coefficient increases. The liquid flux favors the melting of powder-like part of waste allowing to increase its percentage in charge.

Undesirable impurities (carbon, silicon, chromium etc.) are moved away when using the solid oxidizers (scale, ore etc.) and the gaseous oxygen in melting at the expense of oxidizing refining. With this the aluminium as the most easy oxidized element is also moved away. The quantity of the aluminium remainder in melt is an indication of oxidizing refining efficiency.

If starting charge is very soiled and full extraction of undesirable impurities is riot possible at this stage of melting then the melt is transferred into another installation —a mixer or an induction furnace —wherein the final oxidizing refining is carried out. Then the metal is additionally alloyed up to predetermined chemical composition in the same installation.

When the necessary melt purity is succeeded to attain at first stage of process then the melt is transferred into a mixer or into an induction furnace in order to average its chemical composition and there only additional alloying up to ALNIKO alloy composition is carried out.

The quantity of a non-metal component in the waste used for melting could not be less than 3% because this is the minimal level of soiling at which the oxidizing refining is necessary at all. On the other hand the quantity of a non-metal component should not be more than 60% because otherwise the electrical regime of melting is disturbed.

The oxidizing refining of melt up to remainder aluminium concentration not less than 0.05% is supposed in charge melting in the layer of liquid flux. At these concentrations of aluminium the degree of melt oxidation is sufficient for removing off all undesirable impurities to definite limits. If the content of remainder aluminium in melt is less than 0.05% then the melt will be superoxidized resulting in loss of the components when alloying. At the same time the amount of the remainder aluminium at this stage of melt refining should not be more than 1% because it would be difficult to carry out final refining in induction furnace due to fast growing over of crucible walls with aluminium oxides.

The melting has to be carried out at temperatures more not less than 1500 ° C. because otherwise the metal will not be melted. At the same time the temperature should not be higher than 1800° C. because of intensive corrosion of crucible magnesite lining by melt.

In order that the disclosure will be more fully understood and readily carried into effect, the following detailed description.

An example of invention realization. The melting (run No. 1) of 0.5 t of ALNIKO alloy waste (its composition is listed in Table) containing 40% of a metal component and 60% of non-metal one was carried out in an installation for electric-slag casting with a magnesite crucible and non-consumable graphite electrode. Then oxygen in amount of 10 $m^3$ as solid oxidizer and gas was added to melt. After that the metal bath was transferred into an induction furnace followed by adding again of 2 $m^3$ of oxygen and additional alloying of melt was carried out. For comparison the melting (run No. 2) of 0.5 t of waste (its composition is listed in Table) was also carried out in an arc furnace with magnesite lining according to prototype. The charge was composed of metal (80%) and non-metal (20%) components. Such composition was chosen because at another ratio of components (60% of metal and 40% of non-metal) we failed to melt the charge. The percentage of non-metal component in charge was reduced because it is contained mostly in powder-like waste. The blowing through of 12 $m^3$ of gaseous oxygen was carried out. The results of melts are listed in Table.

| | Experimental results | | | | | | |
|---|---|---|---|---|---|---|---|
| | Charge composition, % by mass | | | Amount of the oxygen introduced, $m^3$ | | Coefficient of a | |
| NoNo | Splashes | Slag | Grinding waste | Solid oxidizer | Gaseous oxidizer | metal component yield, % rel. | Percentage of powder-like waste utilization, % abs. |
| 1 | 10 | 10 | 80 | 8 | 4 | 95 | 80 |
| 2* | 10 | 60 | 30 | — | 12 | 78 | 30 |

*Prototype

The method proposed has the following advantages:

1. Increase in possible using of powder-like waste in the charge by 30–50% abs.
2. Increase in yield coefficient of a charge metal component by 8–15% abs.

Various changes may be resorted to, provided they fall within the spirit and scope of the invention.

I claim:

1. A method of alnico alloy melting, comprising the steps of melting a charge; oxidizing refining of the melted charge, said melting a charge including introducing the charge into a flux that is heated by electrical current; maintaining a temperature of the flux in a range of 1500–1800° C.; and carrying out the oxidizing refining until an aluminum content reaches 0.05–1.0% by mass.

2. A method as defined in claim 1; and further comprising using the charge containing metal components and non metal components, wherein non metal components are maintained in a range of 3–60% by mass.

3. A method as defined in claim 1; and further comprising after the melting, the step of placing the melt into a device selected from the group consisting of a mixer and an induction furnace; and carrying out a final oxidizing refining in the device.

4. A method as defined in claim 1; and further comprising after the melting, placing the melt into a device selected from the group consisting of a mixer and an induction furnace; and carrying out an additional alloying in the device.

5. A method as defined in claim 3; and further comprising, after the final oxidizing refining in the device, carrying out an additional alloying.

* * * * *